US010361481B2

(12) United States Patent
Black et al.

(10) Patent No.: US 10,361,481 B2
(45) Date of Patent: Jul. 23, 2019

(54) SURFACE SCATTERING ANTENNAS WITH FREQUENCY SHIFTING FOR MUTUAL COUPLING MITIGATION

(71) Applicant: Searete LLC, Bellevue, WA (US)

(72) Inventors: Eric J. Black, Bothell, WA (US); Brian Mark Deutsch, Snoqualmie, WA (US); Alexander Remley Katko, Seattle, WA (US); Melroy Machado, Seattle, WA (US); Jay Howard McCandless, Alpine, CA (US); Yaroslav A. Urzhumov, Bellevue, WA (US)

(73) Assignee: The Invention Science Fund I, LLC, Bellevue, WA (US)

( * ) Notice: Subject to any disclaimer, the term of this patent is extended or adjusted under 35 U.S.C. 154(b) by 296 days.

(21) Appl. No.: 15/338,918

(22) Filed: Oct. 31, 2016

(65) Prior Publication Data

US 2018/0123241 A1 May 3, 2018

(51) Int. Cl.
*H01Q 1/52* (2006.01)
*H01Q 13/28* (2006.01)

(52) U.S. Cl.
CPC ..... *H01Q 1/521* (2013.01); *H01Q 13/28* (2013.01)

(58) Field of Classification Search
CPC ..... H01Q 1/521; H01Q 9/04; H01Q 9/145; H01Q 5/30; H01Q 5/22; H01Q 3/22; H01Q 19/067; H01Q 13/28
USPC ..... 703/13, 1
See application file for complete search history.

(56) References Cited

U.S. PATENT DOCUMENTS 3,001,193 A 9/1961 Marie
3,388,396 A 6/1968 Rope et al.
3,604,012 A 9/1971 Lindley
3,714,608 A 1/1973 Barnes et al.
3,757,332 A 9/1973 Tricoles
3,887,923 A 6/1975 Hendrix
4,150,382 A 4/1979 King
4,195,262 A 3/1980 King
4,229,745 A 10/1980 Kruger
4,291,312 A 9/1981 Kaloi
4,305,153 A 12/1981 King
4,489,325 A 12/1984 Bauck et al.
4,509,209 A 4/1985 Itoh et al.
(Continued)

FOREIGN PATENT DOCUMENTS

CN 103222109 A 7/2013
JP 52-13751 A 2/1977
(Continued)

OTHER PUBLICATIONS

Chen "A review of metasurfaces: physics and applications to cite this article: Hou-Tong Chen et al 2016 Rep. Prog. Phys. 79 076401 Manuscript version:"2016 IOP Publishing Ltd. (Year: 2016).*
(Continued)

*Primary Examiner* — Eunhee Kim

(57) ABSTRACT

Inter-element couplings between radiative elements of an antenna can be reduced by increasing resonant frequencies for first selected radiative elements and decreasing resonant frequencies for second selected radiative elements. In some approaches, the radiative elements are coupled to a waveguide and the antenna configuration is a hologram that relates a reference wave of the waveguide to a radiated wave of the antenna. In some approaches, the antenna configuration is modified by identifying stationary points of the hologram and then staggering resonant frequencies for radiative elements within neighborhoods of the stationary points.

20 Claims, 3 Drawing Sheets

(56) References Cited

U.S. PATENT DOCUMENTS 4,672,378 A 6/1987 Drabowitch et al.
4,701,762 A 10/1987 Apostolos
4,780,724 A 10/1988 Sharma et al.
4,832,429 A 5/1989 Nagler
4,874,461 A 10/1989 Sato et al.
4,920,350 A 4/1990 McGuire et al.
4,947,176 A 8/1990 Inatsune et al.
4,978,934 A 12/1990 Saad
5,043,738 A 8/1991 Shapiro et al.
5,198,827 A 3/1993 Seaton
5,455,590 A 10/1995 Collins et al.
5,512,906 A 4/1996 Speciale
5,734,347 A 3/1998 McEligot
5,841,543 A 11/1998 Guldi et al.
5,889,599 A 3/1999 Takemori
6,031,506 A 2/2000 Cooley et al.
6,061,023 A 5/2000 Daniel et al.
6,061,025 A 5/2000 Jackson et al.
6,075,483 A 6/2000 Gross
6,084,540 A 7/2000 Yu
6,114,834 A 9/2000 Parise
6,166,690 A 12/2000 Lin et al.
6,198,453 B1 3/2001 Chew
6,211,823 B1 4/2001 Herring
6,232,931 B1 5/2001 Hart
6,236,375 B1 5/2001 Chandler et al.
6,275,181 B1 8/2001 Kitayoshi
6,313,803 B1 11/2001 Manasson et al.
6,366,254 B1 4/2002 Sievenpiper et al.
6,384,797 B1 5/2002 Schaffner et al.
6,396,440 B1 5/2002 Chen
6,469,672 B1 10/2002 Marti-Canales et al.
6,545,645 B1 4/2003 Wu
6,552,696 B1 4/2003 Sievenpiper et al.
6,633,026 B2 10/2003 Tuominen
6,636,179 B1 10/2003 Woo et al.
6,985,107 B2 1/2006 Anson et al.
7,068,234 B2 6/2006 Sievenpiper
7,151,499 B2 12/2006 Avakian et al.
7,154,451 B1 12/2006 Sievenpiper
7,162,250 B2 1/2007 Misra
7,253,780 B2 8/2007 Sievenpiper
7,295,146 B2 11/2007 McMakin et al.
7,307,596 B1 12/2007 West
7,339,521 B2 3/2008 Scheidemann et al.
7,428,230 B2 9/2008 Park
7,456,787 B2 11/2008 Manasson et al.
7,609,223 B2 10/2009 Manasson et al.
7,667,660 B2 2/2010 Manasson et al.
7,830,310 B1 11/2010 Sievenpiper et al.
7,834,795 B1 11/2010 Dudgeon et al.
7,864,112 B2 1/2011 Manasson et al.
7,911,407 B1 3/2011 Fong et al.
7,929,147 B1 4/2011 Fong et al.
7,995,000 B2 8/2011 Manasson et al.
8,009,116 B2 8/2011 Peichl et al.
8,014,050 B2 9/2011 McGrew
8,040,586 B2 10/2011 Smith et al.
8,059,051 B2 11/2011 Manasson et al.
8,134,521 B2 3/2012 Herz et al.
8,179,331 B1 5/2012 Sievenpiper
8,212,739 B2 7/2012 Sievenpiper
8,339,320 B2 12/2012 Sievenpiper
8,456,360 B2 6/2013 Manasson et al.
9,231,303 B2 1/2016 Edelmann et al.
9,268,016 B2 2/2016 Smith et al.
9,385,435 B2 7/2016 Bily et al.
9,389,305 B2 7/2016 Boufounos
9,450,310 B2 9/2016 Bily et al.
9,634,736 B2 4/2017 Mukherjee et al.
2002/0039083 A1 4/2002 Taylor et al.
2002/0167456 A1 11/2002 McKinzie, III
2003/0214443 A1 11/2003 Bauregger et al.
2004/0227668 A1 11/2004 Sievenpiper
2004/0242272 A1 12/2004 Aiken et al.
2004/0263408 A1 12/2004 Sievenpiper et al.
2005/0031016 A1 2/2005 Rosen
2005/0031295 A1 2/2005 Engheta et al.
2005/0041746 A1 2/2005 Rosen et al.
2005/0088338 A1 4/2005 Masenten et al.
2006/0065856 A1 3/2006 Diaz et al.
2006/0114170 A1 6/2006 Sievenpiper
2006/0116097 A1 6/2006 Thompson
2006/0132369 A1 6/2006 Robertson et al.
2006/0187126 A1 8/2006 Sievenpiper
2007/0085757 A1 4/2007 Sievenpiper
2007/0103381 A1 5/2007 Upton
2007/0159395 A1 7/2007 Sievenpiper et al.
2007/0159396 A1 7/2007 Sievenpiper et al.
2007/0176846 A1 8/2007 Vazquez et al.
2007/0182639 A1 8/2007 Sievenpiper et al.
2007/0200781 A1 8/2007 Ahn et al.
2007/0229357 A1 10/2007 Zhang et al.
2008/0020231 A1 1/2008 Yamada et al.
2008/0165079 A1 7/2008 Smith et al.
2008/0180339 A1 7/2008 Yagi
2008/0224707 A1 9/2008 Wisler
2008/0259826 A1 10/2008 Struhsaker
2008/0268790 A1 10/2008 Shi et al.
2008/0316088 A1 12/2008 Pavlov et al.
2009/0002240 A1 1/2009 Sievenpiper et al.
2009/0045772 A1 2/2009 Cook et al.
2009/0109121 A1 4/2009 Herz et al.
2009/0147653 A1 6/2009 Waldman et al.
2009/0195361 A1 8/2009 Smith
2009/0251385 A1 10/2009 Xu et al.
2010/0066629 A1 3/2010 Sievenpiper
2010/0073261 A1 3/2010 Sievenpiper
2010/0079010 A1 4/2010 Hyde et al.
2010/0109972 A2 5/2010 Xu et al.
2010/0134370 A1 6/2010 Oh et al.
2010/0156573 A1 6/2010 Smith et al.
2010/0157929 A1 6/2010 Karabinis
2010/0188171 A1* 7/2010 Mohajer-Iravani ..... H01P 1/2005 333/175
2010/0238529 A1 9/2010 Sampsell et al.
2010/0279751 A1 11/2010 Pourseyed et al.
2010/0328142 A1 12/2010 Zoughi et al.
2011/0065448 A1 3/2011 Song et al.
2011/0098033 A1 4/2011 Britz et al.
2011/0117836 A1 5/2011 Zhang et al.
2011/0128714 A1 6/2011 Terao et al.
2011/0151789 A1 6/2011 Viglione et al.
2011/0267664 A1 11/2011 Kitamura et al.
2012/0026068 A1 2/2012 Sievenpiper
2012/0038317 A1 2/2012 Miyamoto et al.
2012/0112543 A1 5/2012 van Wageningen et al.
2012/0194399 A1 8/2012 Bily et al.
2012/0219249 A1 8/2012 Pitwon
2012/0268340 A1 10/2012 Capozzoli et al.
2012/0274147 A1 11/2012 Stecher et al.
2012/0280770 A1 11/2012 Abhari et al.
2012/0326660 A1 12/2012 Lu et al.
2013/0069865 A1 3/2013 Hart
2013/0082890 A1 4/2013 Wang et al.
2013/0237272 A1 9/2013 Prasad
2013/0249310 A1 9/2013 Hyde et al.
2013/0278211 A1 10/2013 Cook et al.
2013/0288617 A1 10/2013 Kim et al.
2013/0324076 A1 12/2013 Harrang
2013/0343208 A1 12/2013 Sexton et al.
2014/0128006 A1 5/2014 Hu
2014/0266946 A1 9/2014 Bily et al.
2015/0189568 A1 7/2015 Stanze et al.
2015/0280444 A1 10/2015 Smith et al.
2017/0098961 A1 4/2017 Harpham
2017/0250746 A1 8/2017 Wang et al.

FOREIGN PATENT DOCUMENTS

JP 06-090110 3/1994
JP 2007-081825 A 3/2007

(56) References Cited

FOREIGN PATENT DOCUMENTS

| | | | |
|---|---|---|---|
| JP | 2008-054146 | A | 3/2008 |
| JP | 2008054146 | A | 3/2008 |
| JP | 2010147525 | A | 7/2010 |
| JP | 2010-187141 | A | 8/2010 |
| JP | 2012085145 | A | 4/2012 |
| KR | 10-1045585 | B1 | 6/2011 |
| WO | WO 01/73891 | A1 | 10/2001 |
| WO | WO 2008-007545 | A1 | 1/2008 |
| WO | WO 2008/059292 | A2 | 5/2008 |
| WO | WO 2009/103042 | | 8/2009 |
| WO | WO 2009/103042 | A2 | 8/2009 |
| WO | WO 2010/0021736 | | 2/2010 |
| WO | WO 2012/050614 | A1 | 4/2012 |
| WO | PCT/US2013/212504 | | 5/2013 |
| WO | WO 2013/147470 | A1 | 10/2013 |
| WO | WO 2014/018052 | A1 | 1/2014 |

OTHER PUBLICATIONS

European Search Report; European App. No. : EP 11 832 873.1; dated Sep. 21, 2016; pp. 1-6.
Extended European Search Report; European App. No. : EP 14 77 0686; dated Oct. 14, 2016; pp. 1-7.
PCT International Search Report; International App. No. PCT/US2016/037667; dated Sep. 7, 2016; pp. 1-3.
Korean Intellectual Property Office, Notice of Preliminary Rejection; dated Oct. 15, 2018 (machine translation provided); pp. 1-5.
European Patent Office; Supplementary European Search Report, Pursuant to Rule 62 EPC; App. No. EP 15 80 8884 ; dated Jan. 9, 2018; pp. 1-12.
Japan Patent Office, Office Action, App. No. 2016-500314 (based on PCT Patent Application No. PCT/US2014/017454); dated Mar. 6, 2018; pp. 1-4.
Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.
Chen, Robert; *Liquid Crystal Displays*, Wiley, New Jersey 2011 (not provided).
Chin J.Y. et al.; "An efficient broadband metamaterial wave retarder"; Optics Express; vol. 17, No. 9; p. 7640-7647; 2009.
Chu R.S. et al.; "Analytical Model of a Multilayered Meaner-Line Polarizer Plate with Normal and Oblique Plane-Wave Incidence"; IEEE Trans. Ant. Prop.; vol. AP-35, No. 6; p. 652-661; Jun. 1987.
Colburn et al.; "Adaptive Artificial Impedance Surface Conformal Antennas"; in Proc. IEEE Antennas and Propagation Society Int. Symp.; 2009; p. 1-4.
Courreges et al.; "Electronically Tunable Ferroelectric Devices for Microwave Applications"; *Microwave and Millimeter Wave Technologies from Photonic Bandgap Devices to Antenna and Applications*; ISBN 978-953-7619-66-4; Mar. 2010; p. 185-204; InTech.
Cristaldi et al., Chapter 3 "Passive LCDs and Their Addressing Techniques" and Chapter 4 "Drivers for Passive-Matrix LCDs"; *Liquid Crystal Display Drivers: Techniques and Circuits*; ISBN 9048122546; Apr. 8, 2009; p. 75-143; Springer.
Den Boer, Wilem; *Active Matrix Liquid Crystal Displays*; Elsevier, Burlington, MA, 2009 (not provided).
Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.
Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.
Evlyukhin, Andrey B. and Bozhevolnyi, Sergey I.; "Holographic evanescent-wave focusing with nanoparticle arrays"; Optics Express; Oct. 27, 2008; p. 17429-17440; vol. 16, No. 22; OSA.
Fan, Yun-Hsing et al.; "Fast-response and scattering-free polymer network liquid crystals for infrared light modulators"; Applied Physics Letters; Feb. 23, 2004; p. 1233-1235; vol. 84, No. 8; American Institute of Physics.
Fong, Bryan H. et al.; "Scalar and Tensor Holographic Artificial Impedance Surfaces" IEEE Transactions on Antennas and Propagation; Oct. 2010; p. 3212-3221; vol. 58. No. 10; IEEE.
Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; No. 6-12, 1999; p. 1-9; PSW/PCIM; Chicago, IL.
Kim, David Y.; "A Design Procedure for Slot Arrays Fed by Single-Ridge Waveguide"; IEEE Transactions on Antenna and Propagation; Nov. 1988; p. 1531-1536; vol. 36, No. 11; IEEE.
Kirschbaum, H.S. et al.; "A Method for Producing Broad-Band Circular Polarization Employing and Anisotropic Dielectric"; IRE Trans. Micro. Theory. Tech.; vol. 5, No. 3; p. 199-203; 1957.
Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; : IEEE.
Kuki, Takao et al., "Microwave Variable Delay Line using a Membrane Impregnated with Liquid Crystal"; Microwave Symposium Digest; ISBN 0-7803-7239-5; Jun. 2-7, 2002; p. 363-366; IEEE MTT-S International.
PCT International Search Report; International App. No. PCT/US2011/001755; dated Mar. 22, 2012; pp. 1-5.
Poplavlo, Yuriy et al.; "Tunable Dielectric Microwave Devices with Electromechanical Control"; *Passive Microwave Components and Antennas*; ISBN 978-953-307-083-4; Apr. 2010; p. 367-382; InTech.
Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.
Sato, Kazuo et al.; "Electronically Scanned Left-Handed -Leaky Wave Antenna for Millimeter-Wave Automotive Applications"; Antenna Technology Small Antennas and Novel Metamateriats; 2006; pp. 420-423; IEEE.
Sievenpiper, Dan et al.; "Holographic Artificial Impedance Surfaces for Conformal Antennas"; Antennas and Propagation Society International Symposium; 2005; p. 256-259; vol. IB; IEEE, Washington D.C.
Sievenfiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.
Utsumi, Yozo et al.; "Increasing the Speed of Nlicrostrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.
Weil, Carsten et al.; "Tunable Inverted-Microstrip Phase Shifter Device Using Nematic Liquid Crystals", IEEE MTT-S Digest; 2002; p. 367-370; IEEE.
Yan, Dunbao et al.; "A Novel Polarization Convert Surface Based on Artificial Magnetic Conductor"; Asia-Pacific Microwave Conference Proceedings, 2005.
Yee, Hung Y.; "Impedance of a Narrow Longitudinal Shunt Slot in a Slotted Waveguide Array"; IEEE Transactions on Antennas and Propagation; Jul. 1974; p. 589-592; IEEE.
Young et al.; "Meander-Line Polarizer"; IEEE Trans. Ant. Prop.; p. 376-378; May 1973.
Zhong, S.S. et al.; "Compact ridge waveguide slot antenna array fed by convex waveguide divider"; Electronics Letters; Oct. 13, 2005; p. 1-2; vol. 41, No. 21; IEEE.
PCT International Search Report; International App. No. PCT/US2015/028781; dated Jul. 27, 2015; pp. 1-3.
PCT International Search Report; International App. No. PCT/US2014/061485; dated Jul. 27, 2015; pp. 1-3.
PCT International Search Report; International App. No. PCT/US2015/036638; dated Oct. 19, 2015; pp. 1-4.
Patent Office of the Russian Federation (Rospatent) Office Action; Application No. 2013119332/28(028599); dated Oct. 13, 2015; machine translation; pp. 1-5.

(56) References Cited

OTHER PUBLICATIONS

"Array Antenna with Controlled Radiation Pattern Envelope Manufacture Method"; ESA; Jan. 8, 2013; pp. 1-2; http://www.esa.int/Our_Activities/Technology/Array_antenna_with_controlled_radiation_pattern_envelope_manufacture_method.
Crosslink; Summer 2002; pp. 1-56 vol. 3; No. 2; The Aerospace Corporation.
Leveau et al.; "Anti-Jam Protection by Antenna"; GPS World; Feb. 1, 2013; pp. 1-11; North Coast Media LLC; http://gpsworld.com/anti-jam-protection-by-antenna/.
Luo et al.; "High-directivity antenna with small antenna aperture"; Applied Physics Letters; 2009; pp. 193506-1-193506-3; vol. 95; American Institute of Physics.
Smith, David R.; "Recent Progress in Metamaterial and Transformation Optical Design"; NAVAIR Nano/Meta Workshop; Feb. 2-3, 2011; pp. 1-32.
"Spectrum Analyzer"; Printed on Aug. 12, 2013; pp. 1-2; http://www.gpssource.com/faqs/15; GPS Source.
Sun et al.; "Maximum Signal-to-Noise Ratio GPS Anti-Jam Receiver with Subspace Tracking"; ICASSP; 2005; pp. IV-1085-IV-1088; IEEE.
The State Intellectual Property Office of P.R.C.; Application No. 201180055705.8; dated Nov. 4, 2015; pp. 1-11.
PCT International Search Report; International App. No. PCT/US2014/069254; dated Nov. 27, 2015; pp. 1-4.
Amineh et al.; "Three-Dimensional Near-Field Microwave Holography for Tissue Imaging"; International Journal of Biomedical Imaging; Bearing a date of Dec. 21, 2011; pp. 1-11; vol. 2012, Article ID 291494; Hindawi Publishing Corporation.
Belloni, Fabio; "Channel Sounding"; S-72.4210 PG Course in Radio Communications; Bearing a date of Feb. 7, 2006; pp. 1-25.
Diaz, Rudy; "Fundamentals of EM Waves"; Bearing a date of Apr. 4, 2013; 6 Total Pages; located at: http://www.microwaves101.com/encyclopedia/absrobingradar1.cfm.
Frenzel, Lou; "What's The Difference Between EM Near Field and Far Field?"; Electronic Design; Bearing a date of Jun. 8, 2012; 7 Total Pages; located at: http://electronicdesign.com/energy/what-s-difference -between-em-near-field-and-far-field.
Grbic, Anthony; "Electrical Engineering and Computer Science"; University of Michigan; Created on Mar. 18, 2014, printed on Jan. 27, 2014; pp. 1-2; located at: http://sitemaker.umich.edu/agrbic/projects.
Grbic et al.: "Metamaterial Surfaces for Near and Far-Field Applications"; 7th European Conference on Antennas and Propagation (EUCAP 2013); Bearing a date of 2013; Created on Mar. 18, 2014; pp. 1-5.
Imani, et al.; "A Concentrically Corrugated Near-Field Plate"; Bearing a date of 2010, Created on Mar. 18, 2014; pp. 1-4; IEEE.
Imani, et al.; "Design of a Planar Near-Field Plate"; Bearing a date of 2012, Created on Mar. 18, 2014; pp. 1-2; IEEE.
Imani, et al.; "Planar Near-Field Plates"; Bearing a date of 2013; Created on Mar. 18, 2014; pp. 1-10; IEEE.
Islam et al.; "A Wireless Channel Sounding System for Rapid Propagation Measurements"; Bearing a date of Nov. 21, 2012; 7 Total Pages.
Konishi, Yohei; "Channel Sounding Technique Using MIMO Software Radio Architechture"; 12th MCRG Joint Seminar; Bearing a date of Nov. 18, 2010; 28 Total Pages.
Lipworth et al.; "Magnetic Metamaterial Superlens for Increased Range Wireless Power Transfer"; Scientific Reports; Bearing a date of Jan. 10, 2014; pp. 1-6; vol. 4, No. 3642.
Manasson et al.; "Electronically Reconfigurable Aperture (ERA): A New Approach for Beam-Steering Technology"; Bearing dates of Oct. 12-15, 2010; pp. 673-679; IEEE.
Mitri, F.G.; "Quasi-Gaussian Electromagnetic Beams"; Physical Review A.; Bearing a date of Mar. 11, 2013; p. 1; vol. 87, No. 035804; (Abstract Only).
Sakakibara, Kunio; "High-Gain Millimeter-Wave Planar Array Antennas with Traveling-Wave Excitation"; Radar Technology; Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
Siciliano et al.; "25. Multisensor Data Fusion"; Springer Handbook of Robotics; Bearing a date of 2008, Created on Mar. 18, 2014; 27 Total Pages; Springer.
Thoma et al.; "MIMO Vector Channel Sounder Measurement for Smart Antenna System Evaluation"; Created on Mar. 18, 2014; pp. 1-12.
Umenei, A.E.; "Understanding Low Frequency Non-Radiative Power Transfer"; Bearing a date of Jun. 2011; 7 Total Pages; Fulton Innovation, LLC.
Wallace, John; "Flat 'Metasurface' Becomes Aberration-Free Lens"; Bearing a date of Aug. 28, 2012; 4 Total Pages; located at: http://www.laserfocusworld.com/articles/2012/08/flat-metasurface-becomes-aberration-free-lens.html.
Yoon et al.; "Realizing Efficient Wireless Power Transfer in the Near-Field Region Using Electrically Small Antennas"; Wireless Power Transfer; Principles and Engineering Explorations; Bearing a date of Jan. 25, 2012; pp. 151-172.
PCT International Search Report; International App. No. PCT/US2014/070645; dated Mar. 16, 2015; pp. 1-3.
PCT International Search Report; International App. No. PCT/US2014/070650; dated Mar. 27, 2015; pp. 1-3.
The State Intellectual Property Office of P.R.C.; Application No. 201180055705.8; dated May 6, 2015; pp. 1-11.
Intellectual Property Office of Singapore Examination Report; Application No. 2013027842; dated Feb. 27, 2015; pp. 1-12.
European Patent Office, Supplementary European Search Report, pursuant to Rule 62 EPC; App. No. EP 11 83 2873; dated May 15, 2014; 7 pages.
Colburn et al.; "Adaptive Artificial Impedance Surface Conformal Antennas"; in Proc. IEEE Antennas and Propagation Society Int. Symp.; 2009; pp. 1-4.
Hand, Thomas H., et al.; "Characterization of complementary electric field coupled resonant surfaces"; Applied Physics Letters; published on Nov. 26, 2008; pp. 212504-1-212504-3; vol. 93; Issue 21; American Institute of Physics.
McLean et al.; "Interpreting Antenna Performance Parameters for EMC Applications: Part 2: Radiation Pattern, Gain, and Directivity"; Created on Apr. 1, 2014; pp. 7-17; TDK RF Solutions Inc.
Soper,Taylor; "This startup figured out how to charge devices wirelessly through walls from 40 feet away"; GeekWire; bearing a date of Apr. 22, 2014 and printed on Apr. 24, 2014; pp. 1-12; located at http://www.geekwire.com/2014/ossia-wireless-charging/#disqus_thread.
"Wavenumber"; Microwave Encyclopedia; Bearing a date of Jan. 12, 2008; pp. 1-2; P-N Designs, Inc.
Fan, Guo-Xin et al.; "Scattering from a Cylindrically Conformal Slotted Waveguide Array Antenna"; IEEE Transactions on Antennas and Propagation; Jul. 1997; pp. 1150-1159; vol. 45, No. 7; IEEE.
Jiao, Yong-Chang et al.; A New Low-Side-Lobe Pattern Synthesis Technique for Conformal Arrays; IEEE Transactions on Antennas and Propagation; Jun. 1993; pp. 824-831, vol. 41, No. 6; IEEE.
Ovi et al.; "Symmetrical Slot Loading in Elliptical Microstrip Patch Antennas Partially Filled with Mue Negative Metamaterials"; PIERS Proceedings, Moscow, Russia; Aug. 19-23, 2012; pp. 542-545.
PCT International Search Report; International App. No. PCT/US2014/017454; dated Aug. 28, 2014; pp. 1-4.
IP Australia Patent Examination Report No. 1; Patent Application No. 2011314378; dated Mar. 4, 2016; pp. 1-4.
Definition from Merriam-Webster Online Dictionary; "Integral"; Merriam-Webster Dictionary; cited and printed by Examiner on Dec. 8, 2015; pp. 1-5; located at: http://www.merriam-webster.com/dictionary/integral.
Varlamos et al.; "Electronic Beam Steering Using Switched Parasitic Smart Antenna Arrays"; Progress in Electromagnetics Research; PIER 36; bearing a date of 2002; pp. 101-119.
"Aperture", Definition of Aperture by Merriam-Webster; located at http://www.merriam-webster.com/dictionary/aperture; printed by Examiner on Nov. 30, 2016; pp. 1-9; Merriam-Webster, Incorporated.

(56) References Cited

OTHER PUBLICATIONS

PCT International Preliminary Report on Patentability; International App. No. PCT/US2014/070645; dated Jun. 21, 2016; pp. 1-12.
Canadian Intellectual Property Office, Canadian Examination Search Report, Pursuant to Subsection 30(2); App. No. 2,814,635; dated Dec. 1, 2016; pp. 1-3.
Chinese State Intellectual Property Office, First Office Action, App. No. 2015/80036356.3 (based on PCT Patent Application No. PCT/US2015/028781); dated Sep. 5, 2018; machine translation provided, 6 pages total.
Supplementary European Search Report, Pursuant to Rule 62 EPC; App. No. EP 14 87 2595; dated Jul. 3, 2017; pp. 1-16.
Supplementary European Search Report, Pursuant to Rule 62 EPC; App. No. EP 14 87 2874; dated Jul. 3, 2017; pp. 1-15.
European Patent Office, Supplementary European Search Report, Pursuant to Rule 62 EPC; App. No. EP 14891152; dated Jul. 20, 2017; pp. 1-4.
Chinese State Intellectual Property Office, Notification of the First Office Action, App. No. 201580042227.5 (based on PCT Patent Application No. PCT/US2015/036638); dated Sep. 30, 2018; (machine translation provided, 5 pages total).
The State Intellectual Property Office of P.R.C., Fifth Office Action, App. No. 2011/80055705.8 (Based on PCT Patent Application No. PCT/US2011/001755); dated Nov. 16, 2016; pp. 1-3 (machine translation, as provided).
Ayob et al.; "A Survey of Surface Mount Device Placement Machine Optimisation: Machine Classification"; Computer Science Technical Report No. NOTTCS-TR-2005-8; Sep. 2005; pp. 1-34.
Chinese State Intellectual Property Office, First Office Action, App. No. 201480074759.2 (based on PCT Patent Application No. PCT/US2014/069254); dated Jul. 2, 2018; pp. 1-14 (machine translation provided).
Smith et al.; "Composite Medium with Simultaneously Negative Permeability and Permitivity"; Physical Review Letters; May 1, 2000; pp. 4184-4187; vol. 84, No. 18; American Physical Society.
European Patent Office, Communication Pursuant to Article 94(3) EPC; App. No. EP 14872874.4; dated Jul. 16, 2018; pp. 1-8.
European Patent Office, Communication Pursuant to Article 94(3) EPC; App. No. EP 14872595.5; dated Jul. 16, 2018; pp. 1-7.
European Patent Office, Extended European Search Report, Pursuant to Rule 62 EPC; App. No. EP 16812357; dated Dec. 3, 2018; pp. 1-7.
Checcacci et al.; "A Holographic VHF Antenna"; IEEE Transactions on Antennas and Propagation; Mar. 1971; pp. 278-279.
ELsherbiny et al.; "Holographic Antenna Concept, Analysis, and Parameters"; IEEE Transactions on Antennas and Propagation; Mar. 2004; pp. 830-839; vol. 52; No. 3; 2004 IEEE.
Iizuka et al.; "Volume-Type Holographic Antenna"; IEEE Transactions on Antennas and Propagation; Nov. 1975; pp. 807-810.
Sazonov, Dimitry M.; "Computer Aided Design of Holographic Antennas"; IEEE 1999; pp. 738-741.
European Patent Office, Communication Pursuant to Article 94(3) EPC; App. No. 14770686.5; dated Mar. 28, 2019; pp. 1-22.

* cited by examiner

SURFACE SCATTERING ANTENNAS WITH FREQUENCY SHIFTING FOR MUTUAL COUPLING MITIGATION

DETAILED DESCRIPTION

Figure 1:
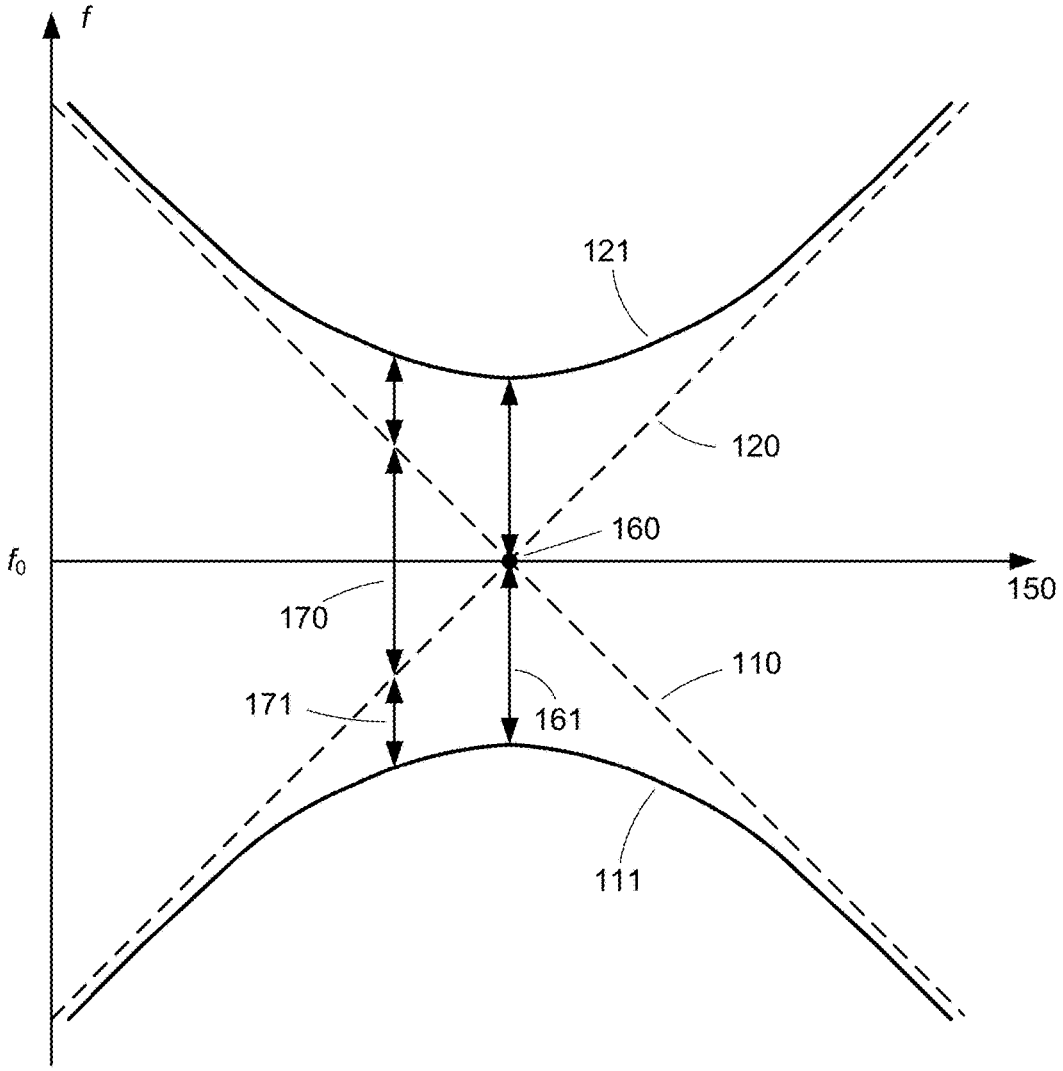
FIG. 1 depicts an example of mutual coupling between coupled oscillators.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The embodiments relate to surface scattering antennas. Surface scattering antennas are described, for example, in U.S. Patent Application Publication No. 2012/0194399 (hereinafter "Bily I"). Surface scattering antennas that include a waveguide coupled to a plurality of subwavelength patch elements are described in U.S. Patent Application Publication No. 2014/0266946 (hereinafter "Bily II"). Surface scattering antennas that include a waveguide coupled to adjustable scattering elements loaded with lumped devices are described in U.S. Application Publication No. 2015/0318618 (hereinafter "Chen I"). Surface scattering antennas that feature a curved surface are described in U.S. Patent Application Publication No. 2015/0318620 (hereinafter "Black I"). Surface scattering antennas that include a waveguide coupled to a plurality of adjustably-loaded slots are described in U.S. Patent Application Publication No. 2015/0380828 (hereinafter "Black II"). And various holographic modulation pattern approaches for surface scattering antennas are described in U.S. Patent Application Publication No. 2015/0372389 (hereinafter "Chen II"). All of these patent applications are herein incorporated by reference in their entirety.

Various surface scattering antennas that are disclosed in the above patent applications often include individual radiative elements having dynamically tunable resonant frequencies, and the radiation patterns of the surface scattering antennas are then adjusted by tuning the resonant frequencies of the individual radiative elements. As a first example, Bily I describes, inter alia, radiative elements that are complementary metamaterial elements having resonant frequencies that are dynamically tunable by adjusting bias voltages applied to conducting islands within each of the complementary metamaterial elements. As a second example, Bily II describes, inter alia, radiative elements that are patch elements having resonant frequencies that are dynamically tunable by applying bias voltages between each patch and a ground plane, with an electrically adjustable material such as a liquid crystal material interposed between each patch and the ground plane. As a third example, Chin I describes, inter alia, radiative elements that are patch elements having resonant frequencies that are dynamically tunable by applying bias voltages between each patch and a ground plane, with a variable impedance lumped element connected between each patch and the ground plane. As a fourth example, Black II describes, inter alia, radiative elements that are slots having resonant frequencies that are dynamically tunable by applying bias voltages to variable impedance lumped elements that span the slots.

In some approaches, a desired antenna configuration for a surface scattering antenna may be identified by selecting resonant frequencies for the radiative elements that collectively radiate to provide the radiative field of the antenna. For example, as discussed in the above patent applications, the desired antenna configuration might be a hologram that relates a reference wave of the waveguide to a radiative wave of the antenna, where the hologram can be expressed as a plurality of couplings between the waveguide and the radiative elements, the couplings being functions of the resonant frequencies. Thus, for example, if the antenna is being operated at a selected frequency (or frequency band), the coupling between the waveguide and a radiative element falls off with increased difference between the operating frequency (or frequency band) of the antenna and the resonant frequency of the element, with the fall-off being described by a characteristic resonance curve for the element (e.g. a Lorentz resonance curve), i.e. peaking at the resonant frequency and substantially falling off when the frequency difference becomes comparable to a frequency linewidth for the element.

However, a system of radiative elements is only approximately described as system of isolated elements having individual resonant frequencies, owing to mutual couplings between the radiative elements. As the physical spacings between the radiative elements are reduced, the mutual couplings increase, so mutual coupling can become significant for a surface scattering antenna having radiative elements with subwavelength spacings between the elements. Embodiments of the present invention mitigate this mutual coupling by shifting the resonant frequencies in a manner that reduces the effects of mutual coupling.

FIG. 1 illustrates how mutual coupling can be attenuated by frequency shifting. The figure depicts first and second resonant frequencies 110 and 120 for a pair of ideal, isolated oscillators, as a function of a hypothetical common parameter 150 that corresponds to a linear decrease of the first frequency 110 and a linear decrease of the second frequency 120 (for example, parameter 150 can correspond to a (parameterization of) an increasing bias voltage or incrementing grayscale tuning level for the first oscillator and a (parameterization of) a decreasing bias voltage or decrementing grayscale tuning level for the second oscillator, or vice versa). When the mutual couplings between the first and second oscillators are neglected, the first and second resonant frequencies merely cross at a frequency 160 where the resonant frequencies 110 and 120 of the isolated oscillators coincide. However, because the first and second oscillators have a mutual coupling, the pair of oscillators collectively oscillate with eigenmodes at a pair of eigenvalue frequencies 111 and 121, illustrating the familiar level repulsion effect seen in any system of coupled oscillators. At the crossover frequency 160, where the individual oscillators would have identical resonant frequencies, the mutual coupling effect is maximal in the sense that the actual resonant frequencies are different from the crossover frequency 160 by a maximal amount 161 above and below the crossover frequency. Away from the crossover frequency, e.g. when the two oscillators are detuned to have a frequency difference 170 between the isolated oscillators, as shown in FIG. 1, the mutual coupling effect is diminished in the sense that the actual resonant frequencies 111 and 121 are different from the uncoupled resonant frequencies 110 and 120 by a smaller difference 171 between the actual and uncoupled resonance frequencies.

Figure 2A:
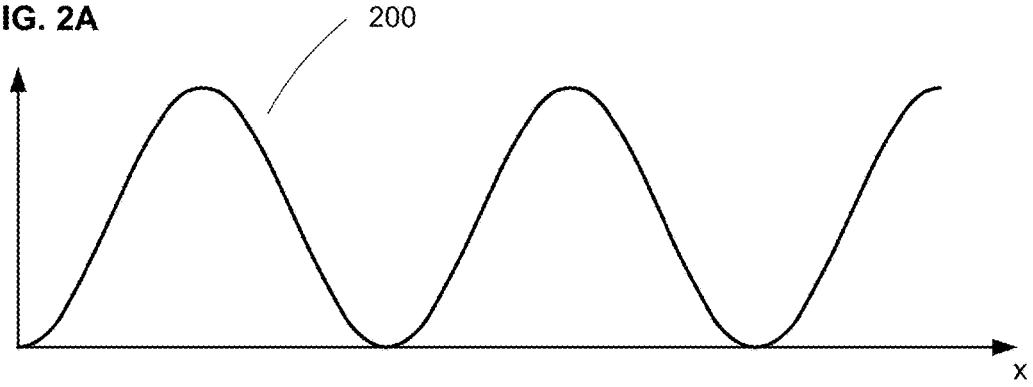
FIGS. 2A-2C depict an example of frequency shifting for radiative elements of a surface scattering antenna.
Figure 2B:
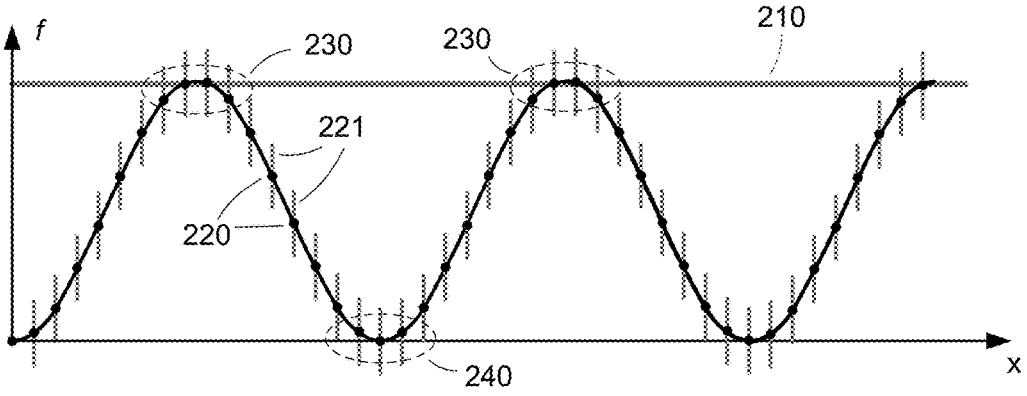
Figure 2C:
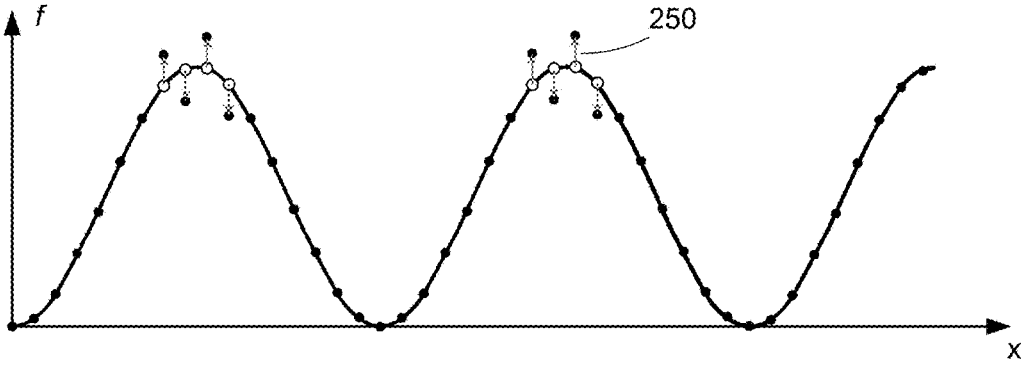

With this illustration of how frequency shifting can mitigate mutual coupling between oscillators, FIGS. 2A-2C depict an example of how the frequency shifting can be applied to the radiative elements of a surface scattering antenna. Without loss of generality, the example relates to a one-dimensional surface scattering antenna that includes a plurality of radiative elements distributed along the length of a one-dimensional wave-propagating structure. Suppose that the desired antenna configuration is a hologram that relates a reference wave of the waveguide to a radiative wave of the antenna. This hologram is schematically depicted as the sinusoid 200 in FIG. 2A. As discussed above, this hologram might be expressed as a plurality of couplings between the waveguide and the radiative elements, the couplings being functions of the resonant frequencies. Thus, as schematically depicted in FIG. 2B, treating the plurality of radiative elements as a system of isolated elements having individual resonant frequencies, the individual resonant frequencies of the radiative elements can be tuned depending upon their positions along the sinusoidal hologram, to thereby implement the sinusoidal hologram and provide the desired antenna radiation pattern. In this schematic illustration, the vertical axis is a frequency axis; the operating frequency (or frequency band) of the antenna is represented by the horizontal bar 210, while the individual resonant responses of the individual radiative elements are represented by the dots 220 (representing the resonant frequencies of the individual oscillators) and the bars 221 (representing the linewidths of the individual oscillators).

When the effects of mutual coupling are considered, the largest effects are likely to occur between neighboring radiative elements having resonant frequencies that are close together and also close to the operating frequency (or frequency band) 210, i.e. providing maximal coupling to the guided wave at the operating frequency (or frequency band). For example, the neighboring elements 230 in a vicinity of a maximum stationary point of the hologram function are likely susceptible to strong mutual coupling because they are strongly driven by to the guided wave mode and also close together in resonant frequency. On the other hand, if the neighboring radiative elements have resonant frequencies that are close together but far away from the operating frequency, the mutual coupling effect between those neighboring radiative elements is lessened because the neighboring radiative elements are not strongly driven by the guided wave mode at the operating frequency (or frequency band). For example, the neighboring elements 240 in a vicinity of a minimal stationary point of the hologram function are not likely susceptible to strong mutual coupling, even though they are close together in resonant frequency, because none of the neighboring elements 240 is strongly driven by the guided wave mode.

Thus, to effectively mitigate mutual coupling effects, it is appropriate to focus on neighboring elements (such as the elements 230 of FIG. 2B) that are situated at or near maximal (strongly driven) stationary points of the hologram function. Here, "maximal" does not necessarily mean that the stationary point is an absolute maximum of the hologram function—it can be any stationary point of the hologram function that is implemented by strong coupling between the reference wave and the radiative elements in a neighborhood of the stationary point. To mitigate the mutual coupling between these strongly driven radiative elements, the resonant frequencies of the elements can be "staggered" by increasing the resonant frequencies of some of the neighboring elements and decreasing the resonant frequencies of other of the neighboring elements. This is schematically depicted in FIG. 2C, wherein the resonant frequencies of the neighboring elements 230 are alternatively shifted up and down by frequency offsets 250. While these frequency offsets represent a departure from the ideal holographic distribution of resonant frequencies 220 as shown in FIG. 2B, the ideal holographic distribution of FIG. 2B ignores the effects of mutual coupling between neighboring elements. The frequency shifting is designed to diminish the mutual coupling effects without unduly distorting the ideal holographic distribution, to restore the desired effect (i.e. the desired antenna radiation pattern) of the ideal holographic distribution.

In some approaches, the neighboring elements whose resonant frequencies are staggered (such as the elements 230 of FIG. 2B) are elements within a selected neighborhood of a maximal stationary point of the hologram function. As discussed above, a maximal stationary point is a stationary point of the hologram function that corresponds to strong, as opposed to weak, coupling between the reference wave and the elements in a the vicinity of the stationary point. The selected neighborhood can include all radiative elements within a selected radius of the maximal stationary point. For example, the selected radius can be equal to some fraction of a wavelength of the reference wave, e.g. a radius of one wavelength of the reference wave, three-quarters of the wavelength of the reference wave, one-half of the wavelength of the reference wave, one-quarter of the wavelength of the reference wave, etc. In some approaches, the surface scattering antenna includes a two-dimensional waveguide such as a parallel-plate waveguide, and the selected neighborhood includes all elements within a two-dimensional disc having the selected radius and centered on the maximal stationary point. In other approaches, the surface scattering antenna includes one or more one-dimensional waveguide fingers, and the selected neighborhood includes all elements within a one-dimensional interval along a selected finger, having the selected radius (i.e. having a range of twice the selected radius) and centered on the maximal stationary point. While the above discussion has focused on a single maximal stationary point, it will be appreciated that, for a given surface scattering antenna and a given hologram antenna, there may be any number of maximal stationary points, each corresponding to a local maximum of the hologram function, and thus a number of neighborhoods wherein the resonant frequencies of the neighboring elements are staggered. For example, for a surface scattering antenna that includes a set of one-dimensional waveguide fingers, the hologram function may be defined as a sinusoid on each finger, and for each finger, there is a maximal stationary point for each peak of the sinusoid, and thus a neighborhood of each sinuosoid peak wherein the resonant frequencies of the radiative elements are staggered to mitigate mutual coupling.

In various approaches, the amount of the frequency shifting can be constant within a selected neighborhood (with each element's resonant frequency shifted either up or down by a constant amount that does not vary within the neighborhood) or varied within the selected neighborhood (with each elements' resonant frequency shifted either up or down by an amount that varies within the neighborhood). Approaches that use constant frequency shifting can include using frequency shifts equal to some fraction of a resonance linewidth of a radiative element, e.g. one resonance linewidth, one-half of a resonance linewidth, one-quarter of a resonance linewidth, one-tenth of a resonance linewidth, etc. Approaches that use varied frequency shifting can include using frequency shifts with magnitudes that decrease with distance from the stationary point, or using frequency shifts that reflect the resonant frequency across an operating frequency. In the former approach, the frequency shifts might be characterized in terms of a dimensional scale factor multiplied by a dimensionless function that falls off, e.g. exponentially or as a power law, with distance from the stationary point. The dimensional scale factor can equal some fraction of a resonance linewidth of a radiative element, as above. In the latter approach, supposing that the antenna is operating at a frequency $f_0$, if the ideal hologram prescribes that a radiative element have a resonant frequency $f_0-\delta$, the radiative element can instead be frequency-shifted to have a resonant frequency $f_0+\delta$. This would provide a coupling of the same amplitude, albeit with different phase, between the reference wave and the element in question, supposing, as is likely the case, that the amplitude frequency response of the element is symmetric or nearly symmetric about its resonant frequency.

Figure 3:
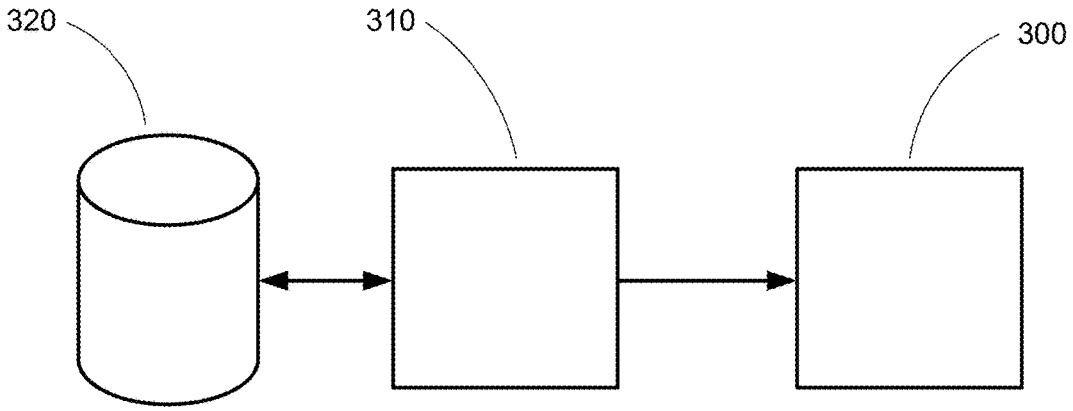
FIG. 3 depicts a system block diagram.

With reference now to FIG. 3, an illustrative embodiment is depicted as a system block diagram. The system includes an antenna 300 coupled to control circuitry 310 operable to adjust the surface scattering to provide particular antenna configurations. The antenna includes plurality of adjustable radiative elements having a respective plurality of adjustable resonant frequencies, as discussed above. It will be appreciated that the inclusion of the antenna 300 within the system is optional; in some approaches, the system omits the antenna and is configured for later connection to such an antenna. The system optionally includes a storage medium 320 on which is written a set of pre-determined antenna configurations. For example, the storage medium may include a set of antenna configurations, each stored antenna configuration being previously determined according to one or more of the approaches set forth above. In other words, the storage medium may include a set of antenna configurations that are selected to increase first selected resonant frequencies for first selected radiative elements and to decrease second selected resonant frequencies for second selected radiative elements adjacent to the first selected radiative elements, whereby to reduce couplings between the first selected radiative elements and the second selected radiative elements Then, the control circuitry 310 would be operable to read an antenna configuration from the storage medium and adjust the antenna to the selected, previously-determined antenna configuration. Alternatively, the control circuitry 310 may include circuitry operable to calculate an antenna configuration according to one or more of the approaches described above, and then to adjust the antenna for the presently-determined antenna configuration.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method, comprising:

identifying a desired antenna configuration that defines a plurality of resonant frequencies for a respective plurality of radiative elements of an antenna; and modifying the desired antenna configuration to increase resonant frequencies for first selected radiative elements and to decrease resonant frequencies for second selected radiative elements adjacent to the first selected radiative elements, whereby to reduce couplings between the first selected radiative elements and the second selected radiative elements;

wherein the radiative elements are coupled to a waveguide and the desired antenna configuration is a hologram that relates a reference wave of the waveguide to a radiated wave of the antenna, where the hologram can be expressed as a plurality of couplings between the waveguide and the radiative elements, the couplings being functions of the resonant frequencies;

wherein the modifying of the desired antenna configuration includes:

identifying a set of stationary points of the hologram; and for each stationary point in the set of stationary points:

identifying radiative elements within a subwavelength neighborhood of the stationary point; and staggering the resonant frequencies for the radiative elements within the subwavelength neighborhood;

wherein the staggering of the resonant frequencies includes:

for some radiative elements within the subwavelength neighborhood, increasing the resonance frequencies by a first selected frequency shift amount; and for other radiative elements within the subwavelength neighborhood, decreasing resonance frequencies by a second selected frequency shift amount;

wherein the first selected frequency shift amount is less than or equal to a resonance linewidth of the radiative elements.

2. The method of claim 1, further comprising:

adjusting the antenna to provide the modified antenna configuration.

3. The method of claim 1, further comprising:

operating the antenna with the modified antenna configuration.

4. The method of claim 1, further comprising:

storing the modified antenna configuration in a storage medium.

5. The method of claim 1, wherein each subwavelength neighborhood includes all radiative elements within a selected radius of the stationary point.

6. The method of claim 1, wherein the waveguide includes a set of one-dimensional waveguide fingers and the hologram is a set of sinusoidal holograms for the set of waveguide fingers.

7. The method of claim 6, wherein, for each waveguide finger, each subwavelength neighborhood includes all radiative elements coupled to the waveguide finger and within a selected radius of the stationary point.

8. The method of claim 7, wherein the staggering of the resonant frequencies includes alternatively increasing and decreasing the resonant frequencies for successive elements within the subwavelength neighborhood.

9. The system of claim 1, wherein each subwavelength neighborhood includes all radiative elements within a selected radius of the stationary point.

10. The system of claim 1, wherein the waveguide includes a set of one-dimensional waveguide fingers and the hologram is a set of sinusoidal holograms for the set of waveguide fingers.

11. The system of claim 10, wherein, for each waveguide finger, each subwavelength neighborhood includes all radiative elements coupled to the waveguide finger and within a selected radius of the stationary point.

12. The system of claim 11, wherein the staggering of the resonant frequencies includes alternatively increasing and decreasing the resonant frequencies for successive elements within the subwavelength neighborhood.

13. A system for operating an antenna with a plurality of adjustable radiative elements having a respective plurality of adjustable resonant frequencies, comprising:

a storage medium on which a set of antenna configurations is written, each antenna configuration being selected to increase first selected resonant frequencies for first selected radiative elements and to decrease second selected resonant frequencies for second selected radiative elements adjacent to the first selected radiative elements, whereby to reduce couplings between the first selected radiative elements and the second selected radiative elements; and control circuitry operable to read antenna configurations from the storage medium and adjust the plurality of adjustable scattering elements to provide the antenna configurations;

wherein the radiative elements are coupled to a waveguide and each antenna configuration corresponds to hologram that relates a reference wave of the waveguide to a radiated wave of the antenna, where the hologram can be expressed as a plurality of couplings between the waveguide and the radiative elements, the couplings being functions of the resonant frequencies;

wherein each antenna configuration is selected by an algorithm that includes:

identifying a set of stationary points of the hologram; and for each stationary point in the set of stationary points:

identifying radiative elements within a subwavelength neighborhood of the stationary point; and staggering the resonant frequencies for the radiative elements within the subwavelength neighborhood wherein the staggering of the resonant frequencies includes:

for some radiative elements within the subwavelength neighborhood, increasing the resonance frequencies by a first selected frequency shift amount; and for other radiative elements within the subwavelength neighborhood, decreasing resonance frequencies by a second selected frequency shift amount;

wherein the first selected frequency shift amount is less than or equal to a resonance linewidth of the radiative elements.

14. The system of claim 13, further comprising:

the antenna with the plurality of adjustable radiative elements having the respective plurality of adjustable resonant frequencies.

15. A method of controlling an antenna with a plurality of adjustable radiative elements having a respective plurality of adjustable resonant frequencies, comprising:

reading an antenna configuration from a storage medium, the antenna configuration being selected to increase first selected resonant frequencies for first selected radiative elements and to decrease second selected resonant frequencies for second selected radiative elements adjacent to the first selected radiative elements, whereby to reduce couplings between the first selected radiative elements and the second selected radiative elements; and adjusting the antenna to provide the antenna configuration;

wherein the radiative elements are coupled to a waveguide and the antenna configuration corresponds to hologram that relates a reference wave of the waveguide to a radiated wave of the antenna, where the hologram can be expressed as a plurality of couplings between the waveguide and the radiative elements, the couplings being functions of the resonant frequencies;

wherein the antenna configuration is selected by an algorithm that includes:

identifying a set of stationary points of the hologram; and for each stationary point in the set of stationary points:

identifying radiative elements within a subwavelength neighborhood of the stationary point; and staggering the resonant frequencies for the radiative elements within the subwavelength neighborhood;

wherein the staggering of the resonant frequencies includes:

for some radiative elements within the subwavelength neighborhood, increasing the resonance frequencies by a first selected frequency shift amount; and for other radiative elements within the subwavelength neighborhood, decreasing resonance frequencies by a second selected frequency shift amount;

wherein the first selected frequency shift amount is less than or equal to a resonance linewidth of the radiative elements.

16. The method of claim 15, further comprising:

operating the antenna in the antenna configuration.

17. The method of claim 15, wherein each subwavelength neighborhood includes all radiative elements within a selected radius of the stationary point.

18. The method of claim 15, wherein the waveguide includes a set of one-dimensional waveguide fingers and the hologram is a set of sinusoidal holograms for the set of waveguide fingers.

19. The method of claim 18, wherein, for each waveguide finger, each subwavelength neighborhood includes all radiative elements coupled to the waveguide finger and within a selected radius of the stationary point.

20. The method of claim 19, wherein the staggering of the resonant frequencies includes alternatively increasing and decreasing the resonant frequencies for successive elements within the subwavelength neighborhood.

* * * * *